US006044492A

United States Patent [19]

Krogh

[11] Patent Number: 6,044,492

[45] Date of Patent: Apr. 4, 2000

[54] GARMENT WITH HIDDEN SUBPANEL

[76] Inventor: Scott M. Krogh, 201 Main St., Iowa Falls, Iowa 50126

[21] Appl. No.: 09/232,236

[22] Filed: Jan. 19, 1999

[51] Int. Cl.[7] ..... A41B 1/00

[52] U.S. Cl. ..... 2/115; 2/69; 2/113; 40/586

[58] Field of Search ..... 2/115, 113, 69, 2/108, 102, 94; 40/586

[56] References Cited

U.S. PATENT DOCUMENTS

| | | | |
|---|---|---|---|
| 2,079,980 | 5/1937 | Anders | 2/115 |
| 4,813,081 | 3/1989 | Cliff et al. | 2/115 |
| 5,175,888 | 1/1993 | Clark | 2/115 |
| 5,347,658 | 9/1994 | Clark | 2/115 |
| 5,943,698 | 8/1999 | Blanks | 2/115 |
| 5,953,757 | 9/1999 | Blanks | 2/115 |
| 5,960,476 | 10/1999 | Danzy | 2/115 |

*Primary Examiner*—Gloria M. Hale

[57] ABSTRACT

A novelty garment having an inner panel exposable through an opening in the principal garment. The garment, such as a T-shirt, may have a weakening arrangement in the outer fabric to facilitate the tearing of an opening through which the inner panel is revealed.

4 Claims, 1 Drawing Sheet

GARMENT WITH HIDDEN SUBPANEL

BACKGROUND AND SUMMARY OF THE INVENTION

This invention pertains to novelty garments such as T-shirts, caps, or the like on which may be printed pictures, advertising slogans, silly sayings or similar printed material.

This type of garment is very common, and may be used for advertising or, on occasion, to call attention to the wearer for other purposes. However, the use of a simple slogan or advertising message is so common as to be noticed barely if at all.

Applicant's garment uses a different and distinct method of gaining attention. By using a torn hole in the garment and displaying the printed material behind that hole, the wearer calls attention first to the torn shirt (or cap or the like) and thence to the printed material. In that way, one of the apparent desires of the wearer of such garments, viz. the desire for attention, will be enhanced.

DESCRIPTION

Figure 1:
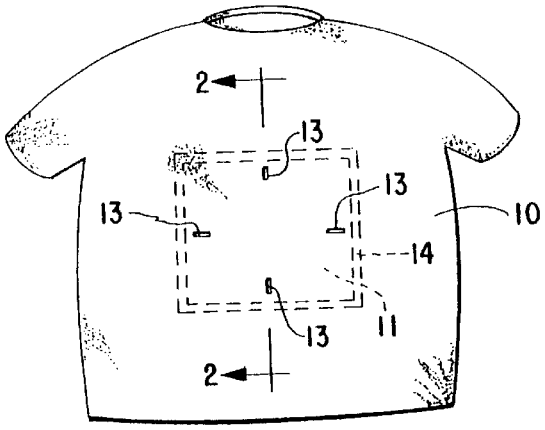
FIG. 1 is a front view of a T-shirt showing the inner panel covered.
Figure 2:
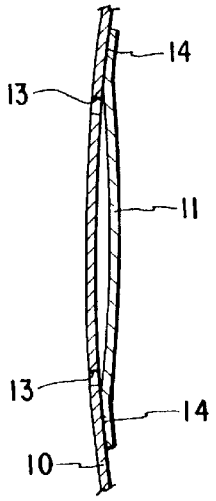
FIG. 2 is a sectional view to an enlarged scale from line 2—2 of FIG. 1.
Figure 3:
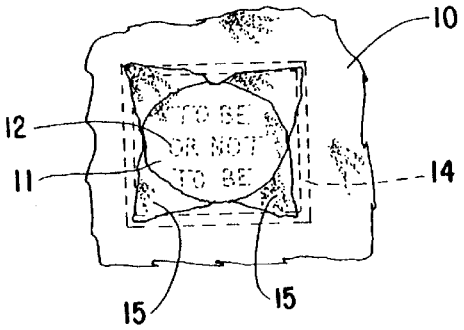
FIG. 3 is a partial view similar to FIG. 1 showing the inner panel partially exposed.

Briefly, this invention comprises a garment having an unusual method of calling attention to itself and to the wearer of the garment.

More specifically and with reference to the drawings, the invention is embodied in a garment such as a T-shirt 10. A second panel 11 is fixed to the inside of the shirt 10, usually at the front, but may be used on the inside of the back or both. The fastening is preferably an adhesive material, probably of the heat sensitive variety, but may be any other type of fastening including stitching, inter-weaving or the like. The fastening covers a small strip 13 continuously around the panel 11.

The inner panel 11 may contain whatever pictorial or printed matter 12 that may be desired. This matter is positioned to be shown through a hole in the original shirt 10 caused by tearing or cutting away of the external material. To make easier the tearing or cutting away of this material, small tears or cuts 13 may be made in the material of the shirt 10 within the boundaries of the fastening material strip 14 for the inner panel 11. These tears or cuts 12 serve to weaken the material of the shirt and make it easy to use shears to cut the material or to insert one's fingers to start tearing the material to open a hole and disclose the panel 11 and printed matter 12 underneath. It will be obvious that the shape and size of the hole may vary depending on how much cutting or tearing is done. And it will further be obvious that the material from the hole may be completely torn or cut off and discarded or be only partly cut away so as to leave ragged edges or lose pieces 15 of material attached to the edge of the hole. The latter processing may be an even greater attention getter than the former.

Figure 4:
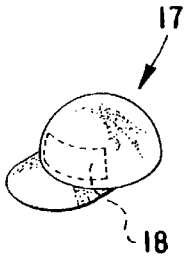
FIG. 4 is a view of a cap showing the use of the invention on an alternative garment.

In FIG. 4, a cap 17 is illustrated to demonstrate that a similar internal panel 18 could be used on a cap 17 with an exterior panel that can be treated similarly to the T-shirt panel. Other garments may also be used with similar attention-getting panels.

I claim as my invention:

1. A garment having an interior and an exterior and made of fabric, an interior panel fastened to the interior of a specific part of said garment, means formed in and surrounding a portion of said specific part of said fabric for weakening said fabric to allow removal of said portion of said specific part to expose said interior panel.

2. The garment of claim 1 in which said interior panel includes printed indicia on said panel visible through said opening.

3. The garment of claim 1 in which said means for weakening said fabric includes slits in said fabric externally of said interior panel.

4. The garment of claim 1 in which said interior panel is fastened to the interior of said garment by a heat-sensitive adhesive material.

* * * * *